United States Patent [19]

Marforio

[11] 4,013,025

[45] Mar. 22, 1977

[54] FABRIC TENSIONING DEVICE FOR SEWING AND ASSEMBLY UNITS

[75] Inventor: Nerino Marforio, Milan, Italy

[73] Assignee: Rockwell-Rimoldi S.p.A., Milan, Italy

[22] Filed: Oct. 9, 1975

[21] Appl. No.: 621,217

[30] Foreign Application Priority Data

Feb. 27, 1975 Italy ..... 20684/75

[52] U.S. Cl. ..... 112/121.15; 112/121.26; 112/153

[51] Int. Cl.[2] ..... D05B 21/00

[58] Field of Search ..... 112/121.26, 121.15, 112/203, 148, 153, 136, 152

[56] References Cited

UNITED STATES PATENTS

| | | | |
|---|---|---|---|
| 85,364 | 12/1868 | Carpenter | 112/148 |
| 2,444,335 | 6/1948 | Coppock | 112/121.15 |
| 3,013,513 | 12/1961 | Judelson | 112/203 |
| 3,463,101 | 8/1969 | Ansel | 112/121.15 |
| 3,713,408 | 1/1973 | Deeks et al. | 112/121.26 X |
| 3,903,818 | 9/1975 | Marforio | 112/121.15 |

*Primary Examiner*—Werner H. Schroeder
*Assistant Examiner*—Peter Nerbun

[57] ABSTRACT

A fabric gripping member for a sewing and assembly unit movable along the work surface of the unit while gripping and holding the ends of pieces of cloth under tension as they are being sewn and advanced along the work surface by a sewing machine. The gripping member includes a device operatively associated therewith for releasing its grip on the pieces of cloth and for returning it to its starting position and in readiness to repeat the cycle.

5 Claims, 5 Drawing Figures

FIG. 3
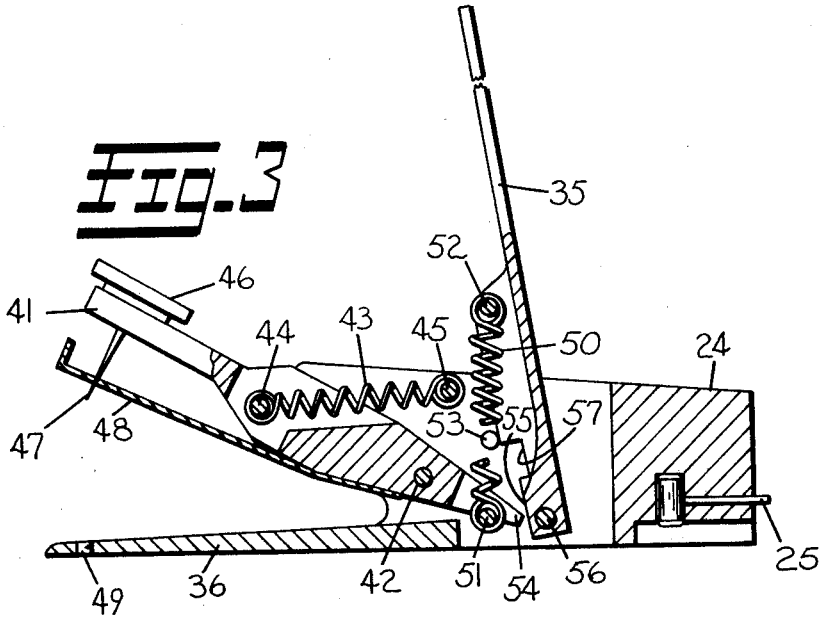
FIG. 5
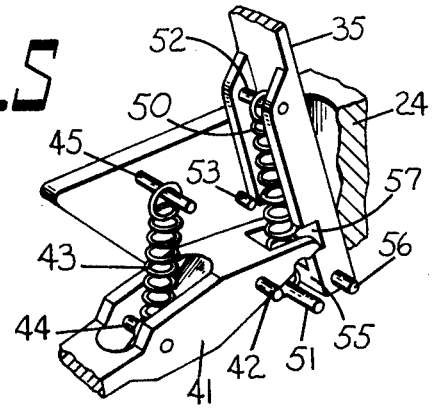
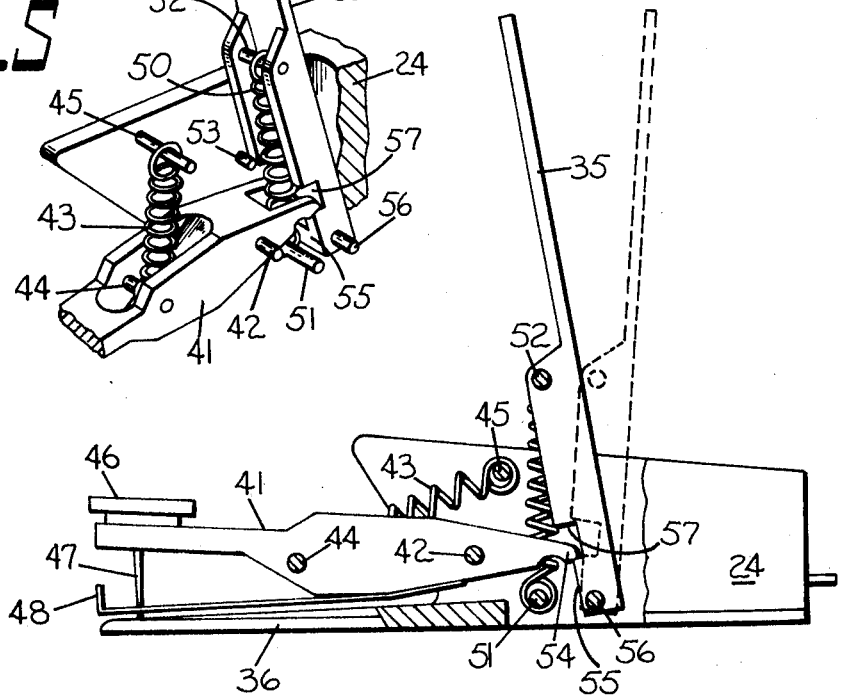
FIG. 4

FABRIC TENSIONING DEVICE FOR SEWING AND ASSEMBLY UNITS

BACKGROUND OF THE INVENTION

The present invention relates to a workpiece tensioning device for sewing and assembly units for pieces of cloth used in producing pants and the like. The sewing unit comprises a table with a work surface and a sewing machine having the well-known sewing and advancement elements is mounted on the work surface. The tensioning device includes movable gripping means provided with a jaw designed to grip one of the ends of the pieces of cloth. It also includes a control means connected to the gripping means and a return means adjustably mounted on the table that is connected to said gripping means. The return means is designed to keep the pieces of fabric or cloth taut as they are moved towards the sewing elements by the advancement elements and to return the gripping means to its starting position upon its release from the fabric. The devices which are used to keep the pieces of cloth to be assembled sufficiently taut, for example, the front and rear sections of the pants, are known and are considered essential although the sewing machines used in the aforementioned units are already regulated to ensure that the outer edges of the pieces of cloth are in alignment.

The difficulty in maintaining the edges of the pieces of cloth in alignment is mainly due to the fact that each section is differently shaped from the other.

In addition, the nature of the material which is used and the manner in which the sections are obtained makes a difference in length in the sections to be joined.

Generally, the two sections to be joined are matched by inserting the leading edges of both beneath the presserfoot of the machine and stretching the pieces slightly to adapt the shorter one to the longer and by applying a tensioning device to the trailing edge of the pieces which have been drawn out in this manner in order to maintain the desired tension until the sewing operation has been completed.

The known tensioning devices are disposed on special guide rails along which they are displaced to follow the sewing operation.

These guide rails are generally embedded in the work surface of the sewing unit on which the operation is taking place and they are inclined with respect to the direction of advancement of the cloth. It is necessary for the guide rails to be embedded in the work surface to keep the pieces of cloth stretched out and the inclination of the rails is designed to enable the tensioning device to follow the lateral displacements of the pieces of fabric with respect to the direction of advancement resulting from the varying profile of the edge to be sewn.

The above-mentioned embedding of the rails tends to reduce the width of the work surface and necessitates the provision of a plate extending the length of the rail to cover the gap which is formed between the work surface and the rail by virtue of the need to vary the direction of the rail as a function of the profile to be sewn.

The object of the present invention is to obviate the disadvantages resulting from the reduction of the work surface and the provision of the guide rail and the covering plate. The technical problem to be solved to attain this object consisted in providing a tensioning device capable of ensuring the necessary tensioning function without the use of rigid guides — however orientable — and of following all the displacements of the article to be assembled.

SUMMARY OF THE INVENTION

The above technical problem was solved by means of a tensioning device of the aforementioned type in which a gripping means is movable on the work surface and is connected to return means by way of a flexible element passing through a guide means of a positioning element which is mounted on the work surface and wherein an actuating means is disposed adjacent to the sewing machine for the purpose of opening the movable gripping means at the end of its travel.

The main advantage of the present invention is that of having a very large work surface which is sufficiently broad on either side of the ideal sewing line and which is clear of obstructions, thus making it possible to sew pieces of cloth having a marked convex shape which produces extensive lateral displacements in the course of operation.

Another advantage consists in that by eliminating any type of guide means for the tensioning device, the work surface can be used both with and without this device.

Other objects features and advantages of the present invention will be made apparent from the following detailed description thereof which is provided with reference to the accompanying drawings, in which:

BRIEF DESCRIPTION OF THE DRAWINGS

FIGS. 3, 4 and 5 are sectional views of the gripping means of the tensioning device.

DESCCRIPTION OF THE PREFERRED EMBODIMENT

Figure 1:
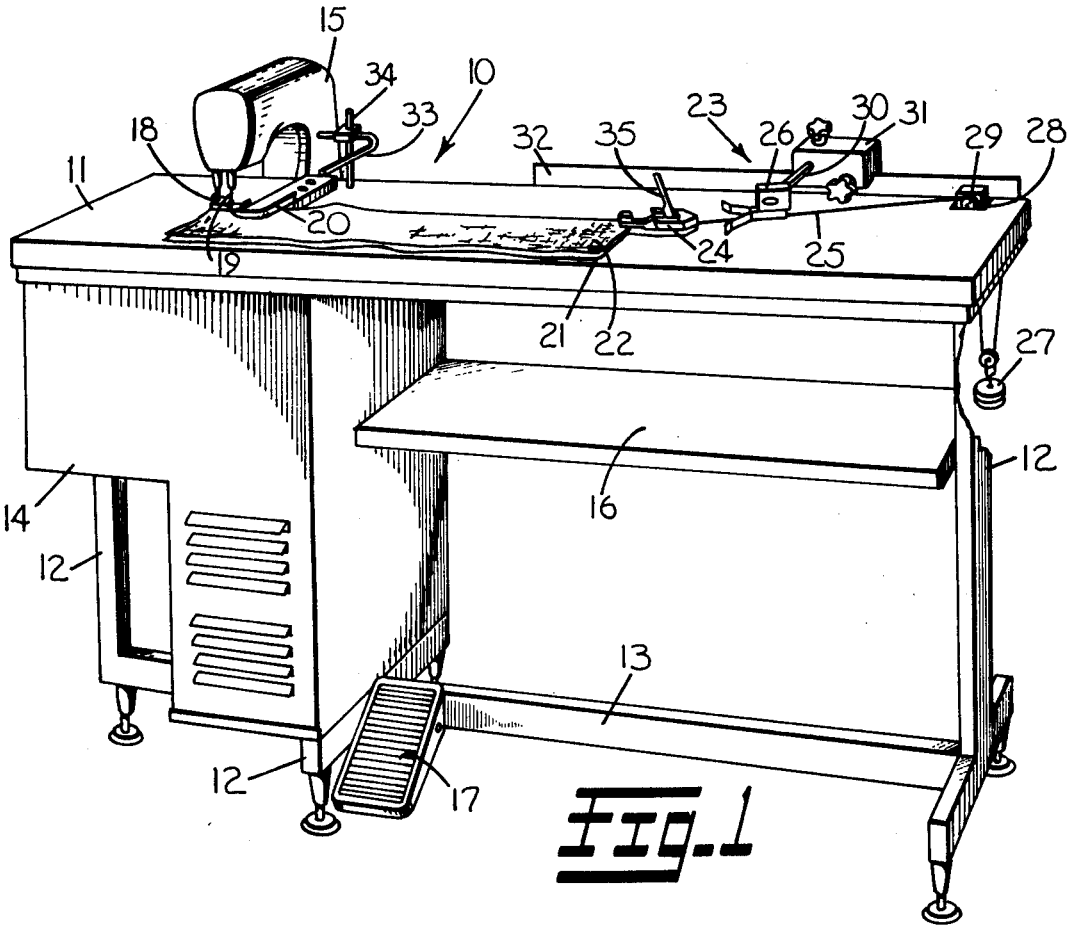
FIG. 1 is a perspective view of a sewing unit.

Referring now to FIG. 1 which shows a sewing and assembly unit for pieces of cloth for producing pants and the like includes a table 10 having a work surface 11 attached to vertical supports 12 that are interconnected by means of a lower cross bar 13. Beneath the work surface 11 and supported by the cross bar 13 a cabinet 14 is provided which houses all the usual electrical components required to control the operating cycle of the sewing machine 15 that is located at one end on the work surface 11.

As this electrical equipment is already known and is of no importance to the present invention it will not be discussed in further detail in the course of the following description.

Beneath the work surface 11 is an additional surface 16 which can be utilized to hold the pieces of cloth to be joined, for example, the parts for the pants, sleeves or the lining for the same.

A pedal 17 is mounted on the cross bar 13 and is used to start the sewing machine and to control the lowering of the presserfoot 18 of the sewing machine 15.

The sewing elements, of which only the needle 19 is visible in FIG. 1, and the advancement elements (not shown) complete the essential parts of the machine. A work guide 20 which is known per se is mounted in front of the sewing machine 15 and serves to align the pieces of cloth 21 and 22 with the sewing elements and to align the edges of the pieces of cloth to be sewn. To operate in the desired manner, the work guide must always be used for the edges which are to be sewn together. In other words, the cloth must constantly be thrust against the guide while it is being displaced under the action of the advancement elements.

As the edges have been cut according to a predetermined shape the pieces of cloth 21 and 22 must also be displaced laterally as they are moved towards the sewing elements in order to maintain contact with the guide means.

To maintain contact between the edges and the work guide and to prevent incorrect mutual positioning of the pieces to be joined from arising during the various displacements, the pieces to be joined are kept matched and adequately stretched out on the work surface by a tensioning device 23.

This tensioning device includes a gripping member 24 designed to grip the trailing end of the cloth and is movable along the work surface 11 in a manner which causes it to follow the movement of the cloth during the sewing operation.

This movable gripping member 24, has a retaining means in the form of a flexible element 25, such as a nylon cable or the like attached at one end which is slidably threaded through suitable guide means in a positioning element 26.

The gripping member 24 is constantly biased by a return means 27 connected to the flexible element and is provided with interchangeable weights members on the free end thereof which are disposed below the work surface 11.

For this reason, the work surface is provided with an opening 28 within which a pulley 29 is mounted and through which the flexible element 25 extends. The positioning element 26 is used to tension the movable gripping member 24 by means of the flexible element 25 which moves about the guide means in element 26. This tension is directed according to the arrow A (FIG. 2) away from the above-mentioned ideal sewing line and is such as to ensure constant contact between the cloth and guide 20. For the purpose of varying this tension, the positioning element 26 is mounted on a shaft 30 adjustable inserted at right angles in a support block 31 which is slidably mounted on a vertical plate 32 integral with the work surface 11 and with respect to which it is also parallel.

The support block 31 which is adjustably secured on the vertical plate 32 is provided for the purpose of positioning this entire unit with respect to the sewing machine and to adapt the starting point of the movable gripping means to the possible length of the cloth.

The tensioning device is completed by an actuating means 33 (FIG. 1) in the form of a horizontal shaft mounted in a vertically adjustable manner on a vertical support 34 disposed forwardly of the sewing machine 15.

The horizontal shaft serves to automatically open the movable gripping member 24 at the end of its travel and thus to release the cloth in a remaining short section of sewing.

The gripping member 24 is opened by means of this shaft which actuates a control finger 35 of said gripping member.

Figure 2:
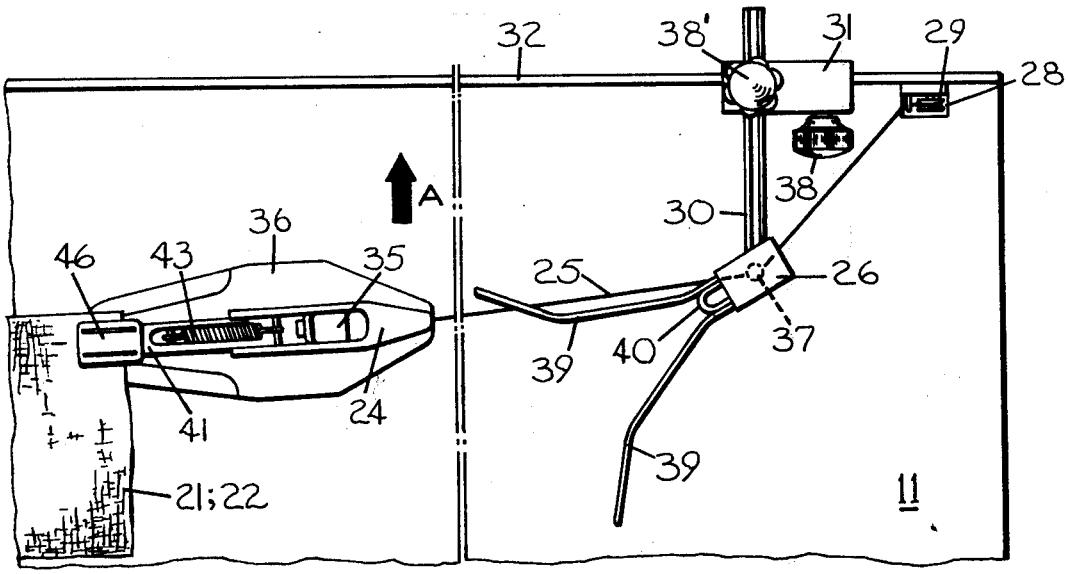
FIG. 2 is a plan view of a portion of the work surface.

Referring now to FIG. 2, the movable gripping member 24 includes a displacement means in the form of a sliding block 36 which rests on the work surface 11, on which it is adapted to move freely, and it is attached to the flexible element 25 which is threaded through a guide 37 formed in the lower part of the positioning element 26 in such a way that it can slide freely in either direction under the action of the pieces of cloth which are tensioned as a function of the pulling force of the above-mentioned return means 27, etc.

As has already been stated, the movable member 24 tends to be displaced in the direction of the arrow A (FIG. 2) while it is moving towards the sewing owing to the predetermined location in which the positioning element 26 is fixed. The positioning element 26 is never aligned parallel with the axis along which the sewing elements of the sewing machine are effecting joining of the cloth.

The component force which is produced and which tends to cause the cloth to be displaced from the ideal sewing line is used to ensure that there is contact between the pieces of cloth being displaced and the work guide 20.

The block 31 includes two fastening knobs 38 and 38' which are respectively designed to attach the block 31 to the vertical plate 32 and the shaft 20 in the block 31.

On that portion which faces towards the sewing machine the positioning element 26 carries two divergent stop plates 39 between which a rubber shock absorber 40 is disposed. These stop plates 39 serve to receive the gripping means when it is released from the cloth and to guide it into its starting position. The stop plates receive the gripping means and direct it towards the shock absorber. Thus it is not directed exactly onto the latter.

The movable gripping means 24 is provided with a jaw member 41 (FIGS. 3, 4 and 5) pivotably mounted on a pin 42 attached to the movable gripping means 24; the jaw member 41 being provided to grip the pieces of cloth to be joined at their trailing edges. A return spring 43 having one end attached to a peg 44 provided on the jaw member and the opposite to a peg 45 mounted on the gripping means 24 urges the jaw member to the open position shown in FIG. 3. The jaw is only closed when it is moved downwards by pressure exerted on the knob 46.

To retain the gripped pieces of cloth the jaw 41 is provided with a pin 47 which passes through a resilient plate 48 designed to press down on the pieces of cloth and which is assembled to the jaw at its lower part. (FIG.4). When the jaw is closed the pin 47 partially penetrates a hole 49 (FIG. 3) provided in the sliding block 36.

The jaw member 41 is automatically closed and opened by means of the control means consisting of a control finger 35 which is constantly urged by a coil spring 50, suitably anchored between a peg 51 carried by the gripping means 24 and a peg 52 carried by said finger, towards a peg 53 which forms a stop for the control means. This peg 53 is disposed on the side of the gripping means 24 on which the movable jaw is pivotably mounted so that said finger will always be engaged by the jaw in the manner described hereinafter.

When the knob 46 is pressed downwardly the jaw member 41 rotates about the pin 42 and causes its forked end 54 to brush against the lower forward surface 55 of the control finger 35 which rotates about its own pin 56 against the action of the coil spring 50 and enables the fork 54 to engage a latching means in the form of a recess 57 provided in said control finger 35.

The entry of the forked end 54 into the recess 57 causes the control finger 35 to assume a position of engagement with the peg 53, thereby preventing the jaw 41 from rotating in an upwardly direction.

When the movable gripping means 24 has been displaced a sufficient distance or in other words when it reaches the vicinity of the sewing machine 15, the horizontal shaft 33 comes into contact with the control finger 35 and causes it to rotate about the pin 56, as a consequence of which the fork 54 is disengaged from the recess 57.

Once the fork 54 has been released it enables the jaws 41 to open under the action of the return spring 43 and the degree of opening is limited by said fork 54 coming into contact with the peg 51.

The jaw 41 can also be opened manually by repeating the same movement on the control finger 35 as was produced by the horizontal shaft 33.

Although the present invention has been described in connection with a preferred embodiment, it is to be understood that modifications and variations may be restored to without departing from the spirit and scope of the invention as those skilled in the art will readily understand. Such modifications and variations are considered to be within the purview and scope of the invention and the appended claims.

I claim:

1. A workpiece gripping device for a sewing and assembly unit for holding and tensioning pieces of cloth being advanced on the unit's work surface while forming pants and the like in which the sewing and assembly unit includes the usual sewing and advancement elements, said gripping device comprising:

a. a gripping means defining a sliding block (36) supported for unrestricted directional movement on the work surface having a pivotal jaw member for holding the ends of the pieces of cloth most remote from the sewing and advancing elements;

b. control means operatively connected to said jaw member for moving the latter between positions for gripping and releasing the cloth;

c. retaining means connected to said gripping means having a biasing means for applying a braking force to said gripping means and maintaining tension on the cloth as it is moved along the work surface; and d. actuating means carried on the work surface for engaging said control means to effect movement of said jaw member to that position for releasing the cloth and returning said gripping means to its initial position under the influence of said biasing means.

2. The gripping device according to claim 1 wherein said control means includes a pivotal control finger (35) having a latching means for holding said jaw member in a position for gripping the cloth.

3. The gripping device according to claim 1 wherein said gripping means includes a positioning element (26) fixed on the work surface for positioning said gripping means in its starting positions and which includes a guide means (37) through which said retaining means extends.

4. The gripping device according to claim 1 wherein said retaining means defines a cable with weight members assembled on the free end thereof to define said biasing means.

5. The gripping device according to claim 1 wherein said actuating means includes a horizontally disposed shaft supported above the work surface and adjacent the sewing machine.

* * * * *